United States Patent [19]

Sequeira et al.

[11] 4,115,242

[45] Sep. 19, 1978

[54] SOLVENT DEWAXING PROCESS

[75] Inventors: Avilino Sequeira, Port Arthur; Herbert J. Pitman, Nederland; Charles W. Harrison, Nederland; Jerry E. Quasny, Nederland, all of Tex.

[73] Assignee: Texaco Inc., New York, N.Y.

[21] Appl. No.: 813,142

[22] Filed: Jul. 5, 1977

[51] Int. Cl.[2] ..... C10G 43/08

[52] U.S. Cl. ..... 208/33; 208/37

[58] Field of Search ..... 208/33

[56] References Cited

U.S. PATENT DOCUMENTS

| | | | |
|---|---|---|---|
| 2,410,483 | 11/1946 | Dons et al. | 208/37 |
| 3,350,297 | 10/1967 | Torobin | 208/33 |
| 3,764,517 | 10/1973 | Bodemuller | 208/33 |
| 3,850,740 | 11/1974 | Gudelis et al. | 208/33 |

OTHER PUBLICATIONS

Chen et al., "Chemical Engineering", Mar. 19, 1977, pp. 105 to 111.

*Primary Examiner*—Herbert Levine

*Attorney, Agent, or Firm*—Carl G. Ries; Thomas H. Whaley; Douglas H. May, Jr.

[57] ABSTRACT

A process wherein a light waxy petroleum distillate stock, having a viscosity less than about 200 SUS at 100° F, is heated for melting any wax therein, wherein said heated waxy stock is incrementally mixed with a flowing stream of dewaxing solvent, having a temperature in the range of 40°-80° F, for forming an oil/solvent mixture at a temperature 5°-10° F below the depressed cloud point, and wherein the oil/solvent mixture is cooled at a uniform rate in the range of 1°-8° F/min. to a separation temperature in the range of +25° to −40° F for precipitating wax from said mixture.

10 Claims, 1 Drawing Figure

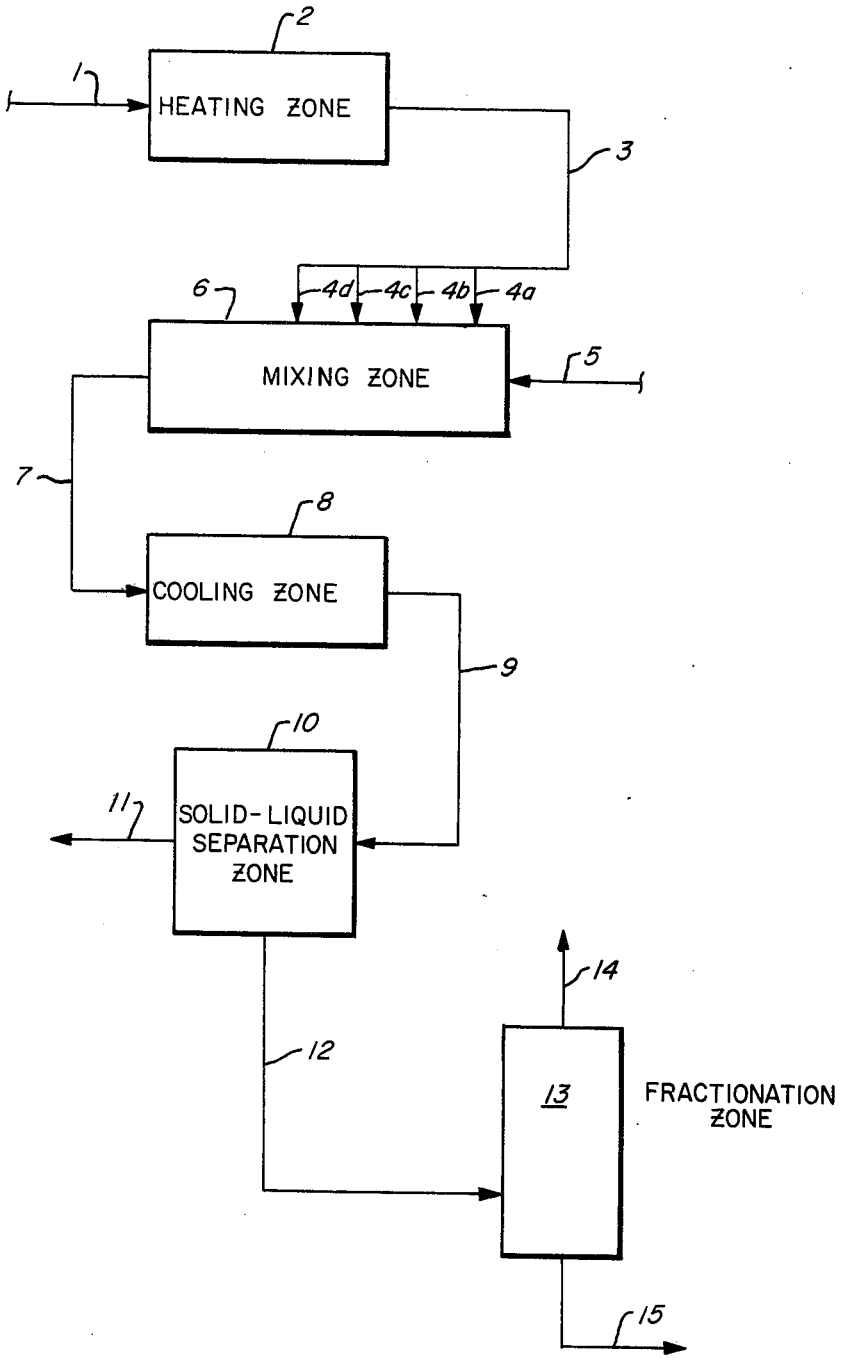
2
1
HEATING ZONE
3
6
4d
4c
4b
4a
MIXING ZONE
5
7
8
COOLING ZONE
9
10
11
SOLID-LIQUID SEPARATION ZONE
14
12
13
FRACTIONATION ZONE
15

SOLVENT DEWAXING PROCESS

BACKGROUND OF THE INVENTION

The present invention relates to a process for dewaxing waxy distillate petroleum oil stocks. More particularly, the invention relates to a solvent dewaxing process wherein heated waxy distillate petroleum oil stock is mixed incrementally with a cooler flowing solvent stream having an initial temperature in the range of about 50°-80° F. (10° to 27° C.) for forming an oil-solvent mixture below the depressed cloud point and cooling the resulting mixture by indirect heat exchange for crystalizing wax therefrom.

DESCRIPTION OF THE PRIOR ART

It is known in the prior art to dewax waxy petroleum oil stocks by cooling oil-solvent solutions at uniformly slow rates, of e.g. 1°-8° F./minute (0.56°-4.4° C./min), under controlled conditions for crystalization of wax from said solutions. Commercially, such oil-solvent solutions are cooled by several methods such as indirect heat exchange in scraped surface exchangers; dilution chilling wherein waxy oil stock is contacted in a multistage tower with chilled solvent under conditions of high levels of agitation (U.S. Pat. No. 3,773,650); and direct chilling, wherein a low boiling solvent, e.g. propylene, mixed with waxy oil stock is vaporized under conditions of reduced pressure.

In such commercial processes, the waxy oil charge, or solutions of waxy oil charge and solvent, are heated to a temperature at which all the wax present is dissolved. The heated charge is then passed into a cooling zone wherein cooling is undertaken at a uniform slow rate in the range of about 1°-8° F./minute (0.56°-4.4° C./min.) until a temperature is reached at which a substantial portion of the wax is crystalized and at which dewaxed oil product has a selected pour point temperature. Upon achieving the desired dewaxing temperature, the mixture of wax crystals, oil and solvent is subjected to solid-liquid separation for recovery of a wax free oil-solvent solution, and a solid wax containing a minor proportion of oil (slack-wax). The separated oil-solvent solution is subjected to fractional distillation for recovery of a solvent fraction and a dewaxed oil product fraction. The slack wax may be recovered as is, or may be subjected to additional processing, such as repulp filtration for removal of additional oil therefrom.

Solid-liquid separation techniques which may be employed for separation of wax crystals from the oil-solvent solutions include known solid-liquid separation processes, such as gravity settling, centrifugation, and filtration. Most commonly, in commercial processes, filtration in a rotary vacuum filter, followed by solvent wash of the wax cake, is employed.

Dewaxing solvents which may be used in solvent dewaxing processes include known dewaxing solvents. Commonly used solvents include aliphatic ketones of 3-6 carbon atoms, $C_2$-$C_4$ range hydrocarbons, $C_6$-$C_7$ aromatic hydrocarbons, halogenated $C_1$-$C_4$ hydrocarbons and mixtures of such solvents. Solvent dilution of waxy oil stocks maintains fluidity of the oil for facilitating easy handling, for obtaining optimum wax-oil separation, and for obtaining optimum dewaxed oil yields. The extent of solvent dilution depends upon the particular oil stocks and solvents used, the approach to filtration temperature in the cooling zone and the desired final ratio of solvent to oil in the separation zone.

For processes employing indirect cooling in scraped surface exchangers, cooling and wax crystalization are accomplished under conditions of very little agitation at a cooling rate in the range of about 1°-8° F./minute (0.56°-4.4° C./min). Under such conditions, without wall scrapers, wax tends to accumulate on the cold exchanger walls interferring with heat transfer, and causing increased pressure drop. Thus, scrapers are employed to remove the accumulated wax. Dewaxing solvents are employed to maintain fluidity of the oil in the coolers and chillers, and may be added before the oil is cooled or in increments during cooling. Often the oil is given a final dilution with solvent at the separation temperature for reducing solution viscosity such that wax separation is more efficient. Commonly, solvent added to the oil in such processes is at the same temperature, or somewhat higher temperature than the oil. Cold solvent, added at substantially lower temperatures than the oil, shock chills the oil resulting in formation of many small wax crystals which are difficult to separate. Under controlled conditions, elongated wax crystals of good size are formed which are easy to separate and which contain little occluded oil.

Dilution chilling processes employ incremental addition of cold solvent, e.g. +25° to −25° F. (−6.7° to −32° C.) to the oil under conditions of agitation such that oil and solvent are completely mixed in less than one second. Under such conditions, wax precipitates in small, hard balls rather than elongated crystals. Such wax precipitates are easy to separate and retain very little oil.

Direct chilling processes employ a low boiling hydrocarbon, e.g. propylene, as dewaxing solvent and refrigerant. Waxy oil stock is diluted with sufficient low boiling hydrocarbon to provide the necessary cooling and provide the desired final dilution for separation of solid wax from the oil-solvent solution. The low boiling hydrocarbon is vaporized from the oil-low boiling hydrocarbon solution under conditions of reduced pressure, at a rate sufficient to cool the solution about 1°-8° F. per minute (0.56°-4.4° C./minute). Such cooling is continued until the desired separation temperature and amount of wax crystalization are obtained. At the separation temperature, sufficient low boiling hydrocarbon remains in solution with the oil to provide the desired fluidity for good separation of wax. Agitation of the mixture being cooled is commonly provided for reduction of temperature and concentration gradients.

In these processes of the prior art, rotating mechanical equipment, either scrapers or high speed agitators, are employed to facilitate good heat transfer from the oil. Such rotary mechanical equipment is expensive, difficult to maintain, and can contribute to breaking and deformation of wax crystals.

SUMMARY OF THE INVENTION

Now, according to the present invention we have discovered improvements to continuous solvent dewaxing processes for separating solid wax from light waxy distillate petroleum oil stocks.

In a preferred embodiment, the improvements of the present invention are applied to a solvent dewaxing process, wherein said waxy oil stock, heated to a temperature wherein all wax is dissolved in said oil stock, is treated with dewaxing solvent in a volume ratio of solvent to oil stock in the range of 1:1 to 5:1 respectively, wherein said mixture of oil and solvent is cooled at a rate of about 1°-8° F. minute (0.56°-4.4° C.minute)

to a selected separation temperature in the range of +25° F. to −40° F. (3.9° to −40° C.) for forming a slurry of wax crystals in oil-solvent solution, wherein said slurry is separated, in a solid-liquid separation zone, into a dewaxed oil-solvent solution and slack wax, and wherein said separated solution is fractionated in a fractionation zone, to yield a solvent fraction and a dewaxed oil fraction; said improvements comprising:

(a) continuously flowing a stream of dewaxing solvent, having a selected temperature in the range of about 40° to 80° F. (4° to 27° C.), into the inlet of a plug flow radial mixing zone at a liquid flow velocity equivalent to 2–8 mixing zone diameters per second;

(b) injecting said heated waxy oil stock into said plug flow radial mixing zone via a plurality of injection nozzles spaced along the length of said mixing zone at intervals;

(c) mixing, in said mixing zone, each portion of waxy oil stock injected via said nozzles intimately with said flowing solvent before injection of the next following portion of waxy oil stock, such that the mixture of waxy oil stock and solvent exiting the outlet of said mixing zone comprises a volume ratio of solvent to oil in the range of about 1:1 to 5:1, and such that the mixture of oil stock and solvent is at a temperature below the depressed cloud point temperature of the mixture, e.g. in the range of about 55°–105° F. (12.8°–40.5° C.);

(d) cooling, in a cooling zone, said mixture of solvent and oil stock from the outlet of said mixing zone, at a rate of about 1°–8° F. per minute (0.56°–4.4° C./min), under conditions of plug flow radial mixing sufficient to limit transverse temperature gradients in the mixture to about 1° F. (0.56° C.) or less, to a separation temperature in the range of about +25° to −40° F. (−3.9° to −40° C.) for crystalizing solid wax from said oil stock-solvent mixture; and (e) flowing the mixture of wax crystals, oil, and solvent from said cooling zone to said solid-liquid separation zone.

The advantages of the present invention over processes of the prior art include elimination of at least a portion of rotating mechanical equipment such as wall scrapers and/or agitators from the dewaxing process. Plug flow radial mixing of the portions of waxy oil stock into the flowing solvent in the mixing zone results in rapid formation of homogeneous mixtures of oil and solvent having only small thermal and concentration gradients. Such plug flow radial mixing is accomplished with static mixers which have no moving parts. Elimination of rotating mechanical equipment reduces cost of constructing solvent dewaxing facilities, and reduces manpower, expense and down time required for operating and maintaining such rotating mechanical equipment.

In a preferred embodyment of the present invention plug flow radial mixing of the oil-solvent mixture in the cooling zone is employed. For cooling zones employing indirect heat exchange, such as double pipe heat exchangers improved heat transfer from the oil-solvent mixture to the refrigerant fluid in the cooling zone reduces operating costs by improving efficiency. However, the greatest advantage is that transverse temperature differentials across the cross-sectional area of flowing oil-solvent mixture, from the cold wall to the center of the oil-solvent mixture is reduced to about 1° F. (0.56° C.) or less, such that substantial subcooling of portions of the mixture close to the walls is avoided, thus reducing deposition of wax upon said cold walls. These advantages, and others will be explained more fully in the detailed description which follows.

BRIEF DESCRIPTION OF THE DRAWING

The drawing is a schematic representation of a solvent dewaxing process employing improvements of the present invention.

DESCRIPTION OF TERMS

Light waxy petroleum distillate oil stocks, contemplated as charge stocks to the solvent dewaxing process of the present invention, have a viscosity of less than 200 SUS at 100° F. (38° C.); and have a boiling range of about 600° F. (315° C.) initial boiling point to about 1050° F. (566° C.) end point. Such light waxy petroleum distillate oil stocks may be derived from raw lube oil stocks the major portion of which boil above 650° F. (343° C.). Such raw lube oil stocks can be vacuum distilled with overhead and side draw distillate streams and a bottom stream referred to as residual oil stock. Considerable overlap in boiling ranges of distillate streams and the residual stream may exist, depending upon distillation efficiency. Some heavier distillates have almost the same distribution of molecular species as the residual stream. Preferably, paraffinic crude oils are used as sources of lube oil stocks.

Such distillate streams contain aromatic and polar compounds which are undesirable in lubricating oils. Such compounds may be removed, by means such as solvent extraction, hydrogenation, and other means well known in the art, either before or after solvent dewaxing. Treatment of distillate streams for removal of aromatic and polar compounds before solvent dewaxing reduces the volume of oil to be dewaxed, which concomitantly reduces the amount of solvent employed, heat load, etc.

The wax content of a waxy distillate oil stock is defined by the amount of material to be removed to produce a dewaxed oil with a selected pour point temperature in the range of +25° to −40° F. (−3.9° to −40° C.). Wax content of waxy distillate oil stock will vary in the range of 5 to 35 wt. percent. The wax material removed in solvent dewaxing is a complex mixture of straight chain and branched chain paraffins and naphthenic hydrocarbons. Wax in light distillate oil stocks generally predominantly comprises normal paraffin hydrocarbons which have relatively high crystal growth rates. In solvent dewaxing processes, wax is separated as solid crystals.

Dewaxed oil, as the term is used herein, is the product from the dewaxing process after solid wax and solvent have been removed.

The Pour Point is the temperature at which an oil will cease to flow when chilled under prescribed conditions (ASTM-D-97-66). The pour point temperature of an oil stock is reduced in a solvent dewaxing process by removing wax therefrom. The pour point temperature of dewaxed oil determines the useful temperature range of lubricating oil manufactured therefrom, and is indicative of other properties such as viscosity, etc.

The Cloud point is the temperature at which a cloud or haze of wax crystals first appears when a wax containing oil is cooled under prescribed conditions (ASTM-D-2500-66). The cloud point of a waxy oil stock may be depressed by addition of solvent in which oil and wax are soluble. The amount of cloud point depression is dependent upon degree of dilution with solvent, nature of feedstock, type or mixture of solvents employed, etc.

Dewaxing Solvents which may be used in the process of the present invention, may be selected from: aliphatic ketones of 3 to 6 carbon atoms; lower molecular weight hydrocarbons e.g. ethane, propane, butanes, and particularly propylene; Aromatic hydrocarbons such as benzene and toluene; halogenated low molecular weight hydrocarbons of 1 to 4 carbon atoms, e.g. dichlorethane, methylenechloride. etc; and mixtures of the above. Particularly useful dewaxing solvent mixtures are: mixture of methyl ethyl ketone and methyl isobutyl ketone; mixtures of ketones with propylene; mixtures of ketone with $C_6$–$C_7$ aromatic hydrocarbons and mixtures of dichloroethylene and methylenechloride. Particularly useful in the process of the present invention are mixtures comprising 30–70 volume percent methyl ethyl ketone and 70–30 volume percent toluene.

Solvent Dilution, within contemplation of the present invention, comprises diluting the waxy oil charge stock with solvent, in volume ratios in the range of about 1:1 to 5:1 solvent to oil, for improving wax removal from the oil, maintaining fluidity of the oil under cooling, or chilling, conditions in the process, obtaining optimum wax separation rates, and obtaining optimum dewaxed oil yields. The extent of solvent dilution is dependent upon the particular waxy oil stock, the solvent system employed, the extent of cooling in the cooling zone, and the desired final viscosity of the wax/oil/solvent mixture going to the wax separation zone. In the prior art it is known that solvent may be added to waxy oil stock before cooling commences, (referred to as predilution), in increments as the oil stock is cooled, at the exit from the cooling zone, or by a combination of the above methods. One solvent may be added at one point in the solvent dewaxing process and another at another point, or the same solvent or mixture of solvents, may be employed throughout. Generally, it has been observed that addition of a cold solvent (eg. in range of +20° to −25° F. (−7° to −32° C.) to a substantially warmer waxy oil stock, must be accompanied by vigorous agitation for formation of large, easily separated wax crystals. Without vigorous agitation, such cold solvent injected into warm waxy oil stock tends to form extremely small wax crystals which are difficult to separate.

Plug flow radial mixing within contemplation of the present invention refers to mixing the solvent-oil mixture in a tubular mixing zone by splitting the flowing fluid into two or more strata each of which is then helically rotated in one direction about its hydraulic center resulting in radially mixing the flowing fluid such that fluid is forced from the center of the tubular mixing zone outward to the outer wall of the tube, and vice versa, then splitting these strata into two or more additional strata, each of which is then helically rotated in the opposite direction about its hydraulic center, etc. The overall effect of such mixing is to cause the flowing stream to be continuously divided and redivided into strata which are continuously radially inverted, such that elements of the fluid entering at the center of the flowing stream are forced to the outer wall, and vice versa, on a continuous basis. Such radial mixing is accomplished with very little backmixing such that the flow of fluid approximates plug flow. Flow of fluid may be in the laminer range or in the turbulent range. In such plug flow radial mixing, transverse gradients in temperature, velocity and composition are substantially reduced or eliminated. Additionally, heat transfer from the body of flowing fluid to the wall of the mixer is substantially increased. Mechanical devices to accomplish such plug flow radial mixing may be obtained from Kenics Corporation, and are described in "MOTIONLESS MIXERS FOR VISCOUS POLYMERS", Chen and MacDonald, *Chemical Engineering,* Mar. 19, 1973, p. 105*ff.* In the present invention, plug flow radial mixing makes three important contributions to the process: Transverse temperature differences across the flowing fluid are reduced to 1° F. (0.56° C.) or less in the cooling zone such that super cooled oil-solvent mixture does not reside at the cold wall depositing wax thereon; the flow of oil-solvent mixture is directed at the cold wall, scouring away any wax which may accumulate; and, in the mixing zone, solvent and oil are rapidly blended into mixtures having a uniform temperture and composition throughout.

Cooling rate of a waxy oil stock-solvent mixture or solution, in solvent dewaxing processes generally and the process of the present invention particularly, has been observed to be determinate of the size of wax crystals formed in the wax/oil/solvent mixture. Lower cooling rates yield larger, easy to separate crystals, with less oil occluded therein. Conventionally, oil-solvent mixtures are cooled at uniform slow rates in the range of 1°–8° F. per minute (0.56° to 4.4° C./min). Preferably cooling rates are in the range of 1.5°–5° F. per minute (0.83° to 2.78° C./min). Although larger wax crystals containing less occluded oil are formed at lower cooling rates, economy demands that the rate be at least about 1° F. per minute (0.56° C./min). At cooling rates above about 8° F. per minute (4.4° C./min), the wax crystals formed are small, difficult to separate and contain much occluded oil. Nucleation of new wax crystals and growth of existing wax crystals from an oil-solvent mixture are both proportional to the degree of supersaturation of wax in the oil-solvent mixture. As the oil-solvent mixture is cooled, wax crystalization as new nuclei or as growth of existing crystals, lags as a result of mass transfer, such that the mixture is somewhat supersaturated. Nucleation of new wax crystals is favored over crystal growth at higher degrees of supersaturation which result from higher cooling rates. Thus, the lowest economical cooling rate is to be preferred. When waxy oil stock, or oil-solvent mixtures, are cooled to the cloud point, a very large number of small wax crystal nuclei precipitate forming a haze or cloud in the mixture. Under conditions of uniform slow cooling, in the 1°–8° F. per minute (0.56° to 4.4° C./min) range, these small crystals tend to grow into larger, easily separable crystals at the expense of formation of additional small wax crystal nuclei as the temperature is reduced.

DESCRIPTION OF THE DRAWING

For better understanding the process of the present invention reference is now made to the drawing. The drawing is a schematic representation of a solvent dewaxing process employing improvements of the present invention, and only those elements of the process necessary for an understanding of the present invention are included. Mechanical features and process equipment unnecessary for an understanding of the present invention have been omitted for the sake of clarity. The drawing, and the description which follows are intended to demonstrate an embodiment of the present invention, and are not to be construed as limitations of the invention which is set-out in the claims appended to this application.

In the drawing, light waxy petroleum distillate oil stock (waxy oil stock) having physical properties within ranges heretofore set-out in the specifications, and undiluted with dewaxing solvent, flows continuously, via line 1, into heating zone 2. In heating zone 2, the waxy oil stock is heated by indirect heat exchange to a temperature in the range of about 80°–150° F. (26.7° to 65.6° C.) at which all wax present is melted and a completely liquid solution results.

In the drawing, heated waxy oil stock having all wax dissolved therein, flows from heating zone 2, via line 3, into a plurality of injection nozzles 4*a*, 4*b*, 4*c* and 4*d*. Within contemplation of the present invention, the total number of nozzles 4 is not particularly critical, and will be in the range of 3–10.

In the drawing, dewaxing solvent, in the liquid phase, at a temperature in the range of about 50°–80° F., (10° to 26.7° C.), and in an amount equivalent to about 1–5 volumes of waxy oil stock, flows via line 5 into the inlet of mixing zone 6. Dewaxing solvent is selected from known dewaxing solvents, as heretofore set-out in this specification. Particularly useful dewaxing solvents are mixtures comprising about 30–70 vol. percent methyl ethyl ketone, and about 70–30 vol. percent toluene, although other dewaxing solvents such as mixtures of methyl ethyl ketone and methyl isobutyl ketone, and mixtures of ethylene dichloride and methylene chloride may be used to advantage. The amount of solvent may be in the range of 1–5 volumes of waxy oil stock, and, for example, is commonly in the range of about 2–4 volumes of waxy oil stock when the solvent is a mixture comprising 30–70 vol% methyl ethyl ketone and 70–30 vol.% toluene. Dilution of lighter and heavier waxy oil stocks within contemplation of the present invention may require respectively somewhat less or somewhat more solvent for optimum effectiveness. The temperature of solvent entering mixing zone 6, within the range of about 40°–80° F., (4° to 26° C.) is selected such that the resulting oil-solvent solution leaving mixing zone 6 will be at a temperature below the depressed cloud point. Preferably, in the range of about 5°–10° F. (2.8° to 5.6° C.) below the depressed cloud point. Depressed cloud point temperatures for solvent-waxy oil stock solutions within contemplation of the present invention will be in the range of about 60°–105° F. (15.6° to 40.6° C.). Direct cooling of waxy oil stock with solvent by mixing according to the process disclosed herein results in forming wax crystals having very little oil occluded therein and which are easily separated from the oil-solvent mixtures. We have discovered that direct cooling of waxy oil stock with solvent having a temperature in the range of 40°–80° F. is effective for cooling the resulting mixture to a temperature below the depressed cloud point, and does not shock chill the waxy oil stock.

In the drawing, in mixing zone 6, waxy oil stock portions from nozzles 4*a–d* are mixed intimately with the flowing stream of dewaxing solvent under conditions of plug flow radial mixing to form a solution of oil and solvent and to cool this solution about 5°–10° F. (2.8° to 5.6° C.) below the depressed cloud point such that wax crystal nuclei are present in the oil-solvent solution exiting mixing zone 6. Waxy oil stock is injected into the solvent stream flowing in mixing zone 6 as a spray of fine droplets from each nozzle 4. Many nozzles designed for dispersing liquids as a sprays of fine droplets are commercially available and are suited for use in this service. Accordingly, a first portion of heated waxy oil stock equivalent to about ⅓ to 1/10 of the total waxy oil stock is injected in the form of fine droplets, via first nozzle 4*a*, into plug flow radial mixing zone 6 through which the dewaxing solvent is flowing. This first portion of heated waxy oil stock is thoroughly mixed with the dewaxing solvent and the resulting solution has a temperature somewhat above the dewaxing solvent temperature as it enters mixing zone 6. Wax nuclei crystalize under these conditions, and the oil forms a solution with the solvent. Plug flow radial mixing distributes the wax crystals throughout the flowing stream. Upon through mixing of the first portion of waxy oil stock with dewaxing solvent, a second portion of heated waxy oil stock is injected as fine droplets, via nozzle 4*b*, into the flowing solution in plug flow radial mixing zone 6 wherein this second portion of waxy oil stock is throughly mixed with the flowing solution. Wax crystalizes from the second portion of waxy oil stock under these conditions, and tends to accumulate upon the wax crystal nuclei already formed, and the oil enters the solution. This injection of heated waxy oil stock into the flowing solution continues in stages of waxy oil addition followed by through mixing until the entire flowing stream of heated waxy oil stock is combined with dewaxing solvent, with the wax crystals from the previous mixing stage accumulating newly wax. The heated waxy oil stock is injected in portions no larger than about ⅓ the total volume of waxy oil stock flow. Otherwise, too much of the wax is precipitated as small wax crystal nuclei, which because of their great number cannot grow to a size large enough for efficient separation from the oil-solvent solution. Injection of waxy oil stock in portions smaller than about 1/10 the total waxy oil stock flow does not contribute substantially larger wax crystals and is unnecessary.

In the drawing, the wax nuclei-oil-solvent mixture from mixing zone 6 at a temperature about 5°–10° F. (2.8° to 5.6° C.) below the depressed cloud point flows via line 7 into cooling zone 8 for crystallization of additional wax. In cooling zone 8, the mixture is cooled at a uniform rate in the range of 1°–8° per minute (0.56° to 4.4° C./min), preferably 1.5°–5° F. per minute (0.83° to 2.8° C./min), to a selected separation temperature in the range of 25° to −40° F. (−3.9° to −40° C.). During this cooling step, additional wax crystalizes from the oil-solvent solution, thus decreasing the pour point of oil remaining in solution with the solvent. A major portion of wax crystalized in cooling zone 8 accumulates on wax nuclei already present, causing them to grow into easily separable wax crystals. Cooling in cooling zone 8 is continued until sufficient wax is crystalized such that the dewaxed oil product will have a desired pour point in the range of 0° to −25° F. (−17.8° to −31.7° C.) or lower. Cooling in cooling zone 8 is contemplated to be via indirect heat exchange with a refrigerant fluid or via direct heat exchange by vaporizing a portion of dewaxing solvent, such as propylene, at reduced pressure.

In the drawing, wax-oil-solvent mixture, at the selected separation temperature obtained in cooling zone 8, flows via line 9 to solid-liquid separation zone 10 wherein wax crystals are separated from oil-solvent solution. Solid-liquid separation may be accomplished by solid-liquid separation methods known in the art, such as gravity settling, centrifugal separation, filtration, etc. Preferably, and commonly practiced in commercial processes, wax is separated from oil-solvent solutions by vacuum filtration. That is, wax-oil-solvent mixture at the separation temperature flows into a holding tank of a rotary vacuum filter having a rotating filter drum covered with a filter cloth. Oil-solvent solution is pulled through the filter cloth by an imposed vacuum, and wax accumulates upon the cloth as a filter cake. As the drum rotates out of the holding tank, additional oil-solvent solution entrained in the filter cake is pulled through the cloth, and commonly wash solvent is sprayed upon the filter cake to displace additional oil. Wash solvent, which may be the same or different from the dewaxing solvent, is likewise pulled through the filter cloth by vacuum action, carrying dissolved oil with it. After the solvent wash, air may be drawn through the wax filter cake for evaporating residual wash solvent, thereby drying the wax cake. At the end of the filter cycle, the wax cake is removed from the filter cloth by a blast of pressurized air or a scraper, such as a doctor knife, and the rotating drum carries the filter cloth into the holding tank for contact with additional wax-oil-solvent mixture.

In the drawing, wax from solid-liquid separation zone 10, known as slack wax and containing some oil entrained therein, is recovered via conduit 11 for further refining, such as repulp filtration, or for recovery as is. Separated oil-solvent solution, from solid-liquid separation zone 10, flows via line 12 to fractionation zone 13. In fractionation zone 13, the oil-solvent solution is separated into a solvent fraction which is recovered via overhead line 14, and a dewaxed oil fraction which is recovered as product via line 15.

In the process of the present invention, it is contemplated that waxy oil charge stock will be suitable for manufacture of lubricating oils. Thus, a particular waxy oil charge stock will have a boiling range, viscosity, and composition suitable for manufacturing a particular lubricating oil. Solvent dewaxing is performed for removing wax from the waxy charge stock, thereby lowering the pour point temperature to a value suitable for the particular lubricating oil being manufactured. Other refining processes, outside the scope of the present invention, such as solvent extraction, hydrogenation, etc. are commonly performed on the waxy oil charge stock and/or the dewaxed oil for adjusting other properties of the oil, such as viscosity index, to values suitable for the particular lubricating oil.

Production of lubricating oils is relatively low volume operation compared to other petroleum refining operations. Consequently in commercial solvent dewaxing operations it is common practice to process one waxy oil stock at one time and other waxy oil stocks at other times, in blocked out operation.

Heating waxy oil stock in heating zone 2 is preferably by indirect heat exchange from a heating medium such as steam, hot gas, or other heat transfer fluid to the waxy oil stock. Heating zone 2 may conveniently be a heat exchanger such as a shell and tube exchanger, a double pipe exchanger, etc., or heating zone 2 may comprise heating coils suspended in a waxy oil stock storage tank. Heat is transferred from the heating fluid to the waxy oil stock primarily by convection. Maximum temperatures necessary for dissolving all the wax in the light waxy oil stocks contemplated for processing according to the present invention do not exceed about 150° F. (65.6° C.) and commonly do not exceed about 115° F. (46° C.). Consequently, heat exchangers having high radiant heat flux, and hot tube walls, such as direct fired heaters, are not preferred for this service.

In mixing zone 6, waxy oil charge is mixed with flowing solvent in a series of steps each comprising injection of a portion of the waxy oil flow into the solvent followed by plug flow radial mixing to thoroughly mix the oil and solvent. Preferably each portion of waxy oil flow is injected into the solvent via one of the nozzles 4*a–d* as a fine spray of droplets. Such injection improves mixing of the oil and solvent. Plug flow radial mixing of oil and solvent following each waxy oil injection point provides thorough mixing of oil and solvent without use of rotating mixing equipment, consequently construction, operating and maintenance expenses are substantially reduced over conventional dewaxing processes. Plug flow radial mixing, as previously described, comprises a series of steps wherein the flowing stream to be mixed is divided into strata, and each strata is rotated about its hydraulic center, forcing liquid from the center of the flowing streams to the outer walls, and liquid from the outer walls to the center. The next succeeding mixing step redivides the strata from the first step into new divisions, each comprising portions of all the strata from the first step, and rotates the new divisions in the opposite direction about their hydraulic center. Thus in each mixing step, each strata of the liquid (in this case waxy oil stock and solvent) is mixed, and in the next succeeding step, portions of each strata are mixed with each other. In order to obtain the degree of mixing desired for waxy oil and solvent in the present process, upon injection of each portion of waxy oil in the solvent, from about 100,000 to about 1,000,000 divisions and redivisions (strata) of the waxy oil and solvent are required. This degree of mixing requires from about 9 to about 20 mixing elements in the plug flow radial mixer following each point of oil injection. The number of mixing elements will be determined by the degree of mixing and the type of mixer selected. Some commercially available static mixers divide the flow into two strata at each step, and some mixers divide the flow into four strata at each step.

In plug flow radial mixing, a discreet amount of mixing is accomplished by each element at each step. Thus, unlike agitation, where more or less mixing at each stage can be accomplished by increasing or decreasing residence time or agitator speed in that stage, residence time in static mixers does not contribute substantially to the degree of mixing. In plug flow radial mixing, the liquid to be mixed must pass through a certain number of stages for a certain degree of mixing. In the present invention, relatively rapid mixture of waxy oil into solvent following each injection point in the mixing zone is desirable. As each element of the plug flow radial mixers occupies a length equivalent to about 1.5 diameters of the tubular mixing zone, and as mixing zones for commercial scale solvent dewaxing units may conveniently be about 6 inches (15.24 cm) in diameter, a minimum velocity of about 0.5 ft/sec (0.15 m/sec) for solvent and oil in the mixing zone is desirable. Stated in a more generalized way, the preferred minimum velocity of solvent and oil in the mixing zone is equivalent to about one mixing zone diameter per second. A maximum to the flow velocity of waxy oil and solvent in the mixing zone is also desirable. This maximum is preferably equivalent to about eight mixing zone diameters per second. That is, about 4 ft/sec. (1.22 m/sec) for a 6 inch (15.24 cm) diameter mixing zone). Upon injection of heated waxy oil into the cooler solvent, small regions of temperature discontinues develop, which are equilibrated as the oil and solvent are thoroughly mixed. In cooler regions, wax nuclei will form, while in warmer regions wax will remain in solution. As the oil and solvent are mixed and the temperature equilibrates some of the lower melting point wax nuclei formed in the cooler regions will melt and some wax from the warmer regions will crystalize as wax nuclei. This melting and crystallization of wax, that is equilibrating of wax nuclei, takes a little time, and it is desirably completed before the next succeeding injection of heated oil. The maximum velocity, equivalent to about eight mixing zone diameters per second, gives sufficient time for the wax nuclei to equilibrate as the waxy oil-solvent mixture temperature is equilibrated.

Cooling in cooling zone 8 is preferably via indirect heat exchange with a refrigerant fluid, preferably in double pipe heat exchangers. Other indirect heat exchanger configurations, such as Shell and tube, as well as direct heat exchange may be used to advantage. Such double pipe heat exchangers may be equipped with scrapers for removing any deposited wax from the cold exchanger walls. Preferably, however, such rotating mechanical equipment is replaced with stationary plug flow radial mixers. Plug flow radial mixing of the wax-oil-solvent mixture in cooling zone 8 reduces transverse temperature differentials across the flowing mixture to about 1° F. (0.56° C.) or less, such that super cooling of the mixture at the cold wall, and concomitant precipitation of low melting point wax at the cold wall, are avoided. Precipitation of low melting point wax, in a cold zone near the cold wall produces two undesirable effects. The low melting point wax, when exposed to warmer oil-solvent mixture becomes tacky or sticky. This sticky wax then tends to stick to the cold wall of the exchanger, thus contributing to wax build-up, decreased heat exchange rates, increased pressure drops, etc. Also, the sticky wax tends to agglomerate into irregular shaped larger particles containing substantial amounts of occluded oil, thereby contributing to decreased dewaxed oil product yields. As stated above, plug flow radial mixing of the wax-oil-solvent mixture in the cooling zone eliminates stagnant cold liquid at the walls of the heat exchanger, thus the low melting point wax is not precipitated until the entire body of flowing solvent-oil mixture is cooled to the crystalization temperature. Consequently the wax crystals formed are not so sticky and do not tend to accumulate on the heat exchanger wall. Also, in plug flow radial mixing, the flowing mixture is directed at the heat exchanger wall, thus scouring away any wax which may accumulate thereon. Additionally, with plug flow radial mixing in the cooling zone, wax tends to crystalize evenly throughout the flowing wax-oil-solvent mixture such that mass transfer of crystalizing wax from oil-solvent solution to an existing wax crystal is improved. Such improved mass transfer increases the growth rate of wax crystals and decreases the rate of wax crystal nuclei formation in the cooling zone.

For existing solvent dewaxing units employing double pipe heat exchangers, wherein a refrigerant fluid is employed in the exchanger annulus for cooling an oil-solvent mixture in the inner tube, use of static mixers may present an operational problem unless some changes to the refrigeration system are made. The refrigerant fluid generally is substantially colder than the oil-solvent mixture with which it is exchanging heat. Consequently, the exchanger wall is quite cold relative to the temperature of the oil-solvent mixture, and precipitated wax tends to stick to the cold walls. Plug flow radial mixing, by reducing transverse temperature gradients and by directing oil-solvent mixture to the walls, tends to reduce such wax accumulations. However, if the walls are too cold as a result of too great temperature difference between refrigerant fluid and oil-solvent mixture, wax will accumulate thus reducing heat transfer and increasing pressure drop.

Plug flow radial mixing substantially increases heat transfer coefficients, in the range of 3 to 4 times the unmixed heat transfer rate, therefore in existing units, a retrofit with static mixers in double pipe exchangers may also be accompanied by a reduction of temperature differential between the flowing oil-solvent mixture and refrigerant fluid. Reducing the temperature differential results in a relatively warmer exchanger wall at the same heat transfer rate, such that wax will not have such a tendency to accumulate, and the flow of oil-solvent mixture to the wall will wash away accumulated wax.

In many existing solvent dewaxing units, however, investment in refrigeration systems is substantial, and changes in refrigeration fluid temperatures would require substantial revisions. In such cases, it may be desirable to maintain use of scraped wall coolers or chillers in areas where wax accumulation upon exchanger walls is severe, rather than bearing the cost of revising the refrigeration systems. Even in such cases where changes to existing refrigeration systems are not desirable, wall scrapers may be replaced with static mixers in exchangers where the oil-solvent mixture is below about 30° F. (1° C.), for at such temperature the tendency of wax to accumulate upon heat exchanger walls is substantially reduced.

EXAMPLE

In order to demonstrate the process of the present invention, the following example is provided. A waxy petroleum distillate fraction of SAE-5 grade, derived from Arabian Light crude, is dewaxed according to the process of the present invention. Physical properties of the SAE-5 grade oil are given in Table I below:

TABLE I

SAE-5 Grade Wax Distillate

Refractive Index/70° C. — 1.4532
Density/70° C. (g/ml) — 0.8198
Density/15° C. (g/ml) — 0.8577
Pour Point (° C.) — +29
Vis./100° F. (C.S.) — 16.73
Vis./210° F. (C.S.) — 3.66
Viscosity Index — 114

In the example process, SAE-5 grade oil is heated to a temperature of about 86° F. (30° C.) for melting all wax present therein. A continuous flow of heated oil is divided into 4 equal streams for injection into a mixing zone as described below.

A continuous stream of solvent, comprising 70 vol.% methyl ethyl ketone (MEK) and 30 vol.% toluene, is flowed at a rate equivalent to 3.5 times the flow rate of heated oil into the mixing zone at an entering temperature of 50° F. (+10° C.) and a flowing velocity of 1 ft/sec. (0.3 m/sec). The mixing zone comprises a pipe having four nozzles for injection of oil spaced along its length with Kenics (TM) mixers of 20 elements each following each injection nozzle. The nozzles comprise restriction orifices which distribute the oil as fine droplets into the flowing solvent.

The oil/solvent mixture exits the mixing zone at a temperature of 62.6° F. (17° C.), which is below the depressed cloud point of the mixture, such that a haze of wax nuclei is present in the mixture. The mixture is flowed through a cooling zone comprising a double pipe exchanger having Kenics (TM) mixers therein, wherein the mixture is cooled at a rate of 1.8° F. (1° C.) per minute to a temperature of −13° F. (−25° C.). In the cooling zone additional wax is crystallized from the oil-solvent mixture, causing the wax nuclei to grow into filterable crystals.

From the cooling zone, the wax-oil-solvent mixture is transferred to a vacuum filter operating at 400mm Hg. pressure wherein wax is filtered from the oil-solvent mixture. Upon filtration, the wax filter cake is washed with an amount of solvent equivalent to 2.65 volumes of oil charge, and the solvent washed wax cake is air dried for 60 seconds. Dewaxed oil is recovered from the solvent by fractional distillation.

Results of this experiment are shown in Table II.

TABLE II

Dewaxed Oil ld (Vol.% charge) — 74.8
Dewaxed Oil Pour Point (° C.) — −20
Wax Yield (Wt.% charge) — 18.4
Wax Cake Oil Content (Wt.% charge) — 2.9
Filter Capacity (kg. oil/m$^2$ filter/hr) — 270

Dewaxed oil, having a pour point of −20° C., is recovered in an amount equal to 77.1 weight percent (74.8 vol.%) of the oil charge to the process.

Slack wax in an amount equivalent to 18.4 wt.% of the oil charge is recovered, having entrained therein oil equivalent to 2.9 wt.% of the oil charge.

Thus, by following the method of the present invention dewaxed oil of low pour point suitable for use in manufacturing lubricating oils may be produced in good yields. Additionally, slack wax having relatively low amounts of oil entrained therein is also recovered.

We claim:

1. In a continuous solvent dewaxing process wherein a light waxy distillate petroleum oil stock is heated, in a heating zone, to a temperature wherein all wax is dissolved, wherein said heated oil stock is treated with solvent in a solvent to oil volume ratio of 1:1 to 5:1 to form an oil-solvent mixture, and wherein said oil-solvent mixture is cooled, in a cooling zone, at a cooling rate of 1°–8° F./min, to a selected separation temperature in the range of about +25° to −40° F. for precipitating wax from said oil-solvent mixture; where said precipitated wax is separated, in a solid-liquid separation zone, from said oil-solvent mixture to yield slack wax and a free oil-solvent mixture is fractionated, in a fractionation zone, to yield a solvent fraction and a dewaxed oil fraction; the improvement which comprises:

(a) continuously flowing a liquid stream of dewaxing solvent, having a selected temperature in the range of about 40°–80° F., into the inlet of a plug flow radial mixing zone;

(b) injecting said heated waxy oil stock into said dewaxing solvent flowing within said plug flow radial mixing zone via a plurality of injection nozzles spaced along the length of said mixing zone;

(c) mixing, in said plug flow radial mixing zone each injected portion of heated waxy oil stock intimately with said flowing solvent before injection of the next following portion of heated waxy oil stock, for producing an oil-solvent mixture exiting said mixing zone having a temperature below the depressed cloud point;

(d) cooling, in a cooling zone, said oil-solvent mixture to a selected separation temperature in the range of about +25° F. to −40° F., for precipitating wax and forming a wax/oil/solvent mixture; and (e) flowing said wax/oil/solvent mixture from said cooling zone to said solid-liquid separation zone.

2. The process of claim 1 wherein the temperature of said solvent entering said mixing zone is sufficiently low, within the range of about 40°–80° F., and the solvent/oil dilution ratio is sufficiently high, such that the oil/solvent mixture exiting said mixing zone is at a temperature of about 5°–10° F. below the depressed cloud point.

3. The process of claim 2 wherein heated waxy oil stock is injected into the solvent flowing in said mixing zone as a spray of liquid droplets.

4. The process of claim 3 wherein cooling of oil/solvent mixture in said cooling zone is at a uniform rate in the range of about 1.5° to 5° F./minute.

5. The process of claim 4 wherein cooling of oil/solvent mixture at temperatures below about 30° F. is under conditions of plug flow radial mixing.

6. The process of claim 5 wherein cooling of oil/solvent mixture in said cooling zone is via indirect heat exchange with a refrigerant fluid, and wherein dewaxing solvent comprises about 30–70 vol. of methyl ethyl ketone and about 70–30 vol.% toluene.

7. The process of claim 5 wherein cooling of oil/solvent mixture in said cooling zone is under conditions of plug flow radial mixing.

8. The process of claim 7 wherein cooling of oil solvent mixture in said cooling zone is via direct heat exchange.

9. The process of claim 8 wherein cooling of oil/solvent mixture in said cooling zone is via indirect heat exchange with a refrigerant fluid.

10. The process of claim 9 wherein solvent comprises about 30–70 vol.% methyl ethyl ketone and about 70–30 vol.% toluene.

* * * * *